US006015598A

United States Patent [19]

Del Rio-Sandoval

[11] Patent Number: 6,015,598

[45] Date of Patent: Jan. 18, 2000

[54] THREE-DIMENSIONAL STRUCTURE COVERED WITH A PLANAR FILM TAPE

[76] Inventor: Javier M. Del Rio-Sandoval, Calzada de la Viga No. 680, Col., Zapotla, Mexico, 08610

[21] Appl. No.: 09/000,257

[22] PCT Filed: Jul. 30, 1996

[86] PCT No.: PCT/MX96/00015

§ 371 Date: May 19, 1998

§ 102(e) Date: May 19, 1998

[87] PCT Pub. No.: WO97/04693

PCT Pub. Date: Feb. 13, 1997

[30] Foreign Application Priority Data

Jul. 31, 1995 [MX] Mexico ..... 953299

[51] Int. Cl.[7] ..... A47G 33/04; G09F 17/00; G09F 19/00

[52] U.S. Cl. ..... 428/7; 428/11; 428/32; 428/542.6

[58] Field of Search ..... 428/7, 8, 11, 32, 428/542.2, 542.6

[56] References Cited

U.S. PATENT DOCUMENTS

| | | | |
|---|---|---|---|
| 3,802,946 | 4/1974 | Chase | 428/32 |
| 4,196,238 | 4/1980 | Wiggins | 428/11 |
| 4,309,464 | 1/1982 | Rauch | 428/11 |
| 4,483,890 | 11/1984 | Beery et al. | 428/7 |

*Primary Examiner*—Mark L. Bell
*Assistant Examiner*—Veronica F. Faison
*Attorney, Agent, or Firm*—Rothwell, Figg, Ernst & Kurz, P.C.

[57] ABSTRACT

The invention refers to a three-dimensional structure, covered with strips of flat film, consisting of a core or main body, which can be of any shape; a continuous strip of flat film with an exterior finish that is attractive to the eye, which completely covers said core in a uniform, regular, and continuous fashion, by the longitudinal overlapping of the edges of the tape; and, a fastening device, located at the upper part of the core.

12 Claims, 2 Drawing Sheets

THREE-DIMENSIONAL STRUCTURE COVERED WITH A PLANAR FILM TAPE

SCOPE OF THE INVENTION

This invention refers to the technique for the manufacturing of three-dimensional ornaments in the Manufacturing Industry, and more specifically, deals with a three-dimensional structure covered with a strip of flat film.

BACKGROUND OF THE INVENTION

It is commonly known that there are currently several different and varied types of three-dimensional structures available, which are used, among other things, as Christmas ornaments. Thus, innumerable types of Christmas ornaments can be found on the market, in different shapes and designs, such as ornaments in the shape of a ball, bell, apple, drum, barrel, etc.

These Christmas ornaments are made of blown glass, or with a hollow plastic core and a painted surface, or with a solid core of polymeric material, covered with textile yarn of different finishes and colors, etc.

Among the various types of Christmas ornaments, the blown-glass ornaments are the most attractive to the eye of the consumer, principally due to their shiny finish. However, these ornaments have the great disadvantage that they must be handled with extreme care, since they are very fragile and can easily be broken. At times even the person who is handling the ornament could be cut by the glass. They are even worse in the hands of small children. These ornaments break easily when negligent parents allow the children to play with them.

In addition, the monetary factor must be taken into account. Since this type of ornament breaks easily, replacements must be bought frequently, resulting in additional expense.

On the other hand, the polymeric material solid-core ornaments covered with textile yarn are also inconvenient. When the yarn is wound around the core, it is not uniformly distributed on the surface of the ball. This results in an imperfect finish which does not appeal to the eye of the consumer, since the final finish tends to appear dull.

In some cases, it is possible to utilize shiny or metallic thread backed by textile yarn. However, this presents the disadvantage that when the yarn is wound around the ornament, the combination of yarn and thread tends to become twisted, also resulting in an imperfect finish.

The hollow plastic-core ornaments with painted surfaces attempt to achieve the effect of a finish similar to that of the blown-glass ornaments. However, with current techniques, the final finish achieved is not appealing to the eye of the consumer, since most of the time the core shows some defects on the surface which become even more noticeable when painted. In addition, many times the paint itself is not properly applied.

It is important to note that currently, the market does not offer any three-dimensional structures that meet the appearance standards of the blown glass ornaments while maintaining the durability of the plastic ornaments.

Therefore, we have attempted to overcome the deficiencies of current techniques and provide a three-dimensional structure covered with a continuous strip of flat tape or film that offers considerable advantages over traditional Christmas ornaments.

OBJECTS OF THE INVENTION

Keeping in mind the deficiencies of previous techniques, and in order to significantly improve them, one of the goals of this invention is to provide a three-dimensional structure covered with a continuous strip of flat tape, which is simple, practical, and financially feasible to manufacture.

Another goal of this invention is to provide a three-dimensional structure covered with a continuous strip of flat tape which, in accordance with its construction and design, allows us to offer an impact-resistent product.

Another goal of this invention is to provide a three-dimensional structure covered with a continuous strip of flat tape that is very appealing to the eye of the consumer.

The previous goals, as well as other goals and advantages of the invention, are achieved through a three-dimensional structure, covered with a continuous strip of flat tape, consisting of a core or main body, which can be of any shane; a continuous layer of strips of film with a surface finish that is attractive to the eye, which covers said core in a uniform, regular, and continuous fashion, by overlapping the edges of the tape strips; and, with a fastening device located at the upper portion of the core.

BRIEF DESCRIPTION OF THE DIAGRAMS

The new features which are considered to be characteristic of this invention are set forth in detail in the claims attached hereto. Nonetheless, the invention itself, in terms of its construction and method of operation, together with its other goals and advantages, can be better understood by reading the following description of a specific modality, and referring to the accompanying diagrams, in which:

DETAILED DESCRIPTION

Figure 1:
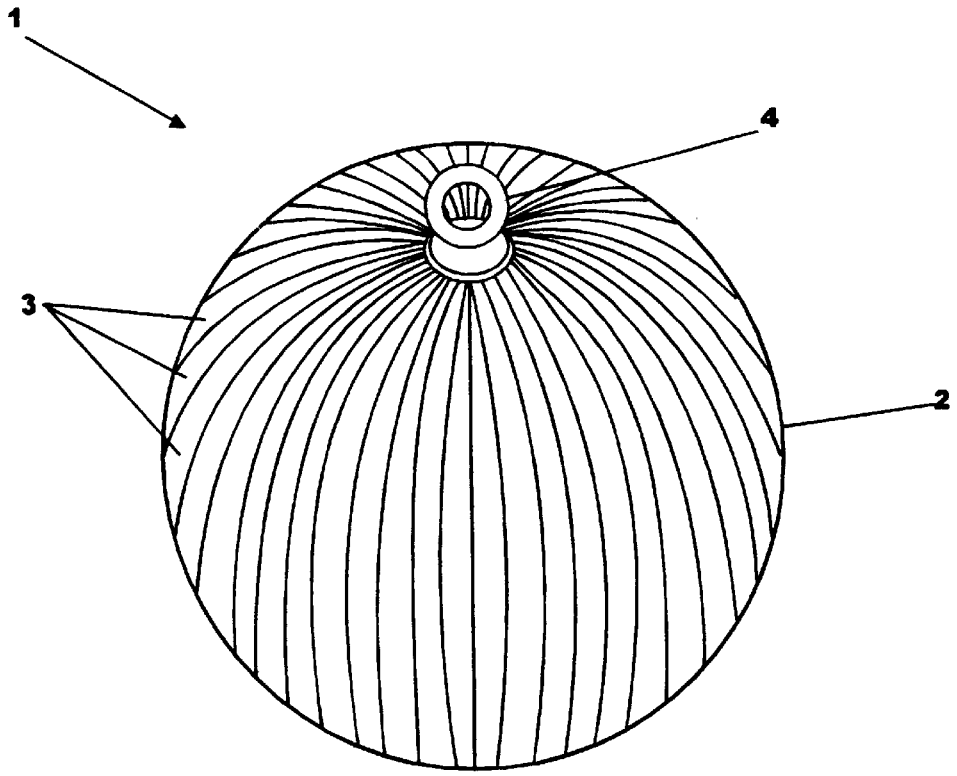
FIG. 1 is a perspective view of the upper elevation of a three-dimensional structure in the shape of a ball, which is covered with a continuous strip of flat tape, put together in accordance with the preferred modality for this invention.
Figure 2:
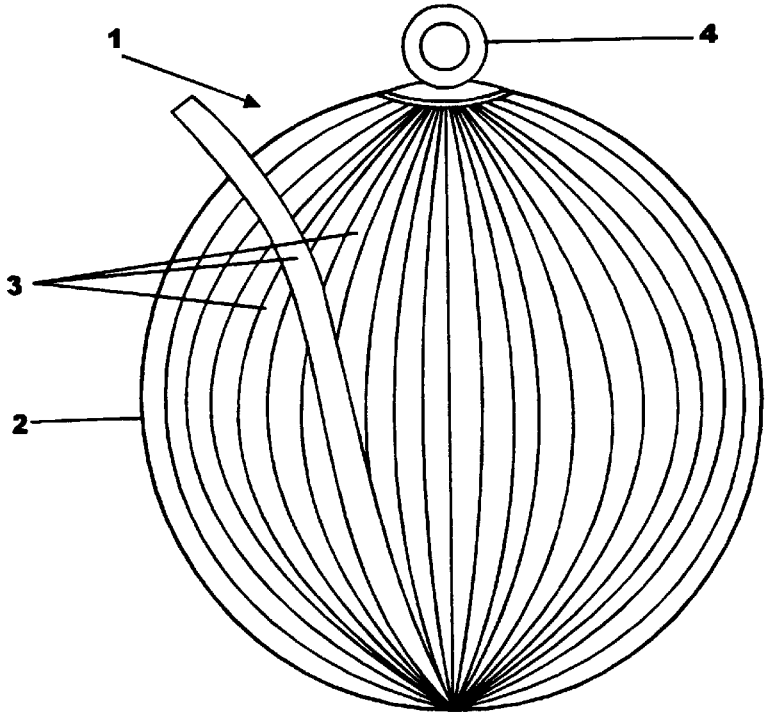
FIG. 2 is a frontal view of the three-dimensional structure in the shape of a ball and covered with a continuous layer of film strips, put together in accordance with the principles of this invention.
Figure 3:
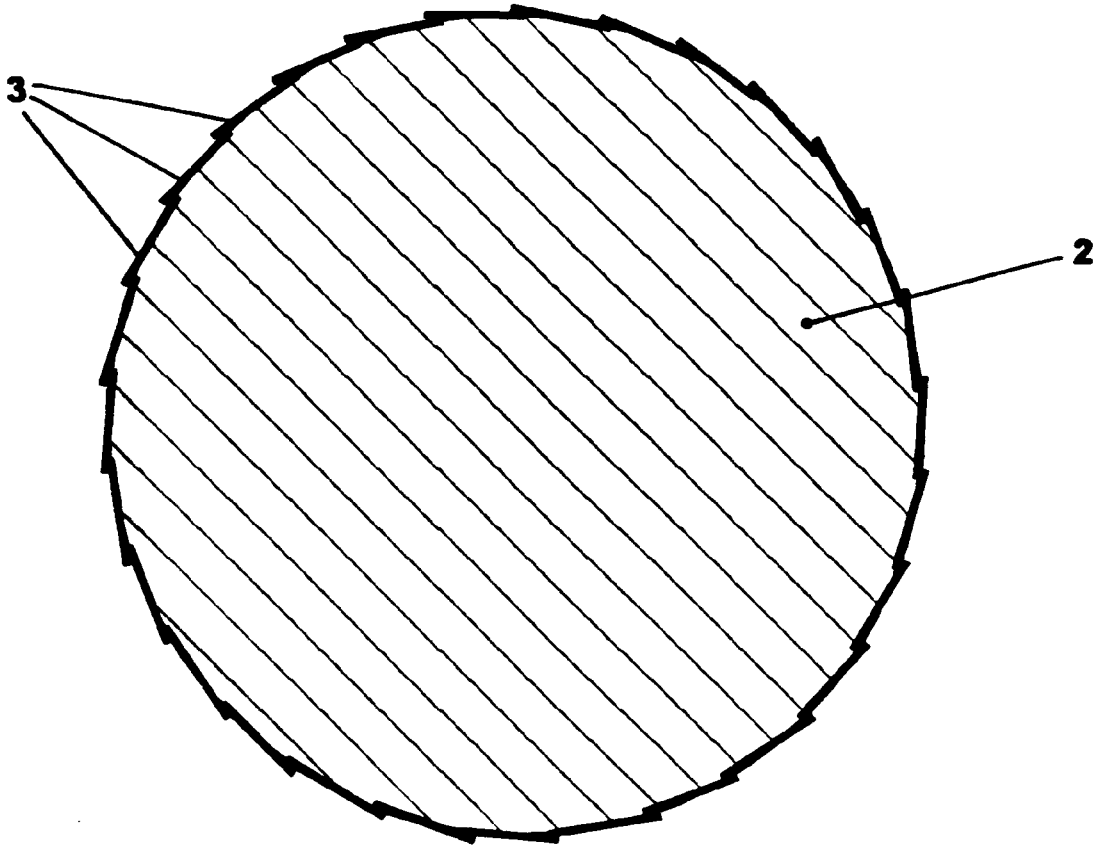
FIG. 3 is a view of a transverse cross-section of the three-dimensional structure in the shape of a ball and covered with a continuous layer of film strips, that shows the manner in which the flat strips of tape are distributed over the surface of the ball, put together in accordance with a specific modality of this invention.

Referring to the attached diagrams and in particular to FIGS. 1 through 3, they show a three-dimensional structure 1, in the shape of a ball and covered with a continuous strip of flat tape, put together in accordance with a specific modality of this invention, that should be considered solely is as an illustration but not limiting same, and that consists of, in general terms, a rigid core or main body 2 in the shape of a ball, which can be solid or hollow; a continuous layer of flat strips of tape 3 unrolled and wound several times around said core 2 so that it is completely covered in a uniform, regular, and continuous fashion, by overlapping the edges of the tape strips 3; and, a fastening device 4, located at the upper portion of said core 2.

The core or main body 2 can be in any three-dimensional shape, such as a ball, apple, bell, drum, barrel, etc.

The core or main body 2 can be made of any polymeric material that is impact-resistent, preferably expanded polystyrene, polyurethane, or blown plastic, which are all light and impact-resistant materials.

The continuous strip of flat tape can be made of any material which is attractive to the eye and in different thicknesses, for example a continuous strip of plastic tape with different finishes, such as shiny finishes, matte finishes, iridescent finishes, etc.

In the modality described, the tape is made of a material with a brilliant surface finish, preferably a plastic film which gives the appearance of a metallic finish.

In order to obtain the three-dimensional structure in the shape of a ball in accordance with the described modality, first the continuous strip of tape 3 is cut in sections which vary in width from approximately 0.5 mm to approximately 10 mm, and taking care that said sections do not get twisted.

Once the continuous strip of flat tape 3 has been cut, said tape 3 is wound several times around the exterior surface of the core 2, the edges of the tape 3 overlapping over themselves longitudinally, until said core 2 is completely covered in a uniform, regular, and continuous fashion.

It is important to mention that, in order to wind the tape in a uniform, regular, and continuous fashion covering the entire surface of the core 2, the tape 3 must not become twisted during the winding process while the core is being covered. For this reason it is necessary to vary the tension used in the application and the width of the sections, as required by the three-dimensional structure that is being covered.

To unwind the tape and cover the surfaces of different three-dimensional structures, you only need to vary the tension and the width of the tape in order to achieve the desired shape.

When the entire surface of the core 2 has been covered with the continuous strip of flat tape 3, the fastening device 4 is inserted in the upper portion of the core 2.

The fastening device 4 may be any type of fastener currently available, and is inserted by pressing into the core 2, in order to have a prop from which to hang the three-dimensional structure 1 once it is finished. Or, said fastener may come already attached as part of the core from the moment it is manufactured.

It is important to mention that the foregoing procedure may be applied to any three-dimensional structure, whether that be in the form of a ball, apple, barrel, bell, drum, etc., in order to obtain a variety of three-dimensional shapes with finishes that are attractive to the eye of the consumer.

In accordance with the foregoing description, you may observe that the three-dimensional structure, covered with a continuous strip of flat tape, of this invention, has been invented in order to produce a product that, in addition to being breakage-resistant, is also appealing to the eye, by unwinding a continuous strip of flat tape over the core.

Even though the foregoing sets forth some specific modalities for this invention, it is important to emphasize that numerous modifications of said modalities are possible without straying too far from the true scope of the invention. Thus, this invention should not be subject to restrictions except for those required by the foregoing techniques and in keeping with the spirit of the attached claims.

We claim:

1. A three-dimensional structure, covered with a continuous strip of flat film, characterized by comprising a core or main body; a continuous strip of flat film wound several times around said core, so that it is completely covered in a uniform, regular, and continuous fashion, by a longitudinal overlapping of the edges of the film; and, a fastening device, located at the upper part of said core.

2. A three-dimensional structure, covered with a continuous strip of flat film, in accordance with claim 1, further characterized by the film wound around without twisting to achieve the uniform, regular, and continuous coverage.

3. A three-dimensional structure, covered with a continuous strip of flat film, in accordance with claim 1, further characterized by the core being rigid.

4. A three-dimensional structure, covered with a continuous strip of flat film, in accordance with claim 3, further characterized by the fact that the core is either solid or hollow, and is of any three-dimensional shape.

5. A three-dimensional structure, covered with a continuous strip of flat film, in accordance with claim 4, further characterized by the core being the shape of a ball, apple, bell, drum, or barrel.

6. A three-dimensional structure, covered with a continuous strip of flat film, in accordance with claim 1, further characterized by the core being made of an impact-resistant polymeric material, either expanded polystyrene or polyurethane.

7. A three-dimensional structure, covered with a continuous strip of flat film, in accordance with claim 1, further characterized by the core being made of blown plastic.

8. A three-dimensional structure, covered with a continuous strip of flat film, in accordance with claim 2, further characterized by the continuous strip of flat film being made of materials with different finishes, selected from the group consisting of shiny finishes, matte finishes, and iridescent finishes.

9. A three-dimensional structure, covered with a continuous strip of flat film, in accordance with claim 8, further characterized by the film being made of a material with a shiny surface finish.

10. A three-dimensional structure, covered with a continuous strip of flat film, in accordance with claim 8, further characterized by the continuous strip of flat film having a width varying from approximately 0.5 mm to approximately 10 mm.

11. A three-dimensional structure, covered with a continuous strip of flat film, in accordance with claim 1, further characterized by the fastening device being part of the core.

12. A three-dimensional structure, covered with a continuous strip of flat film, according to claim 8, further characterized in that the continuous strip of flat film has a width varying from 0.5 mm to 10 mm.

* * * * *